US005983643A

United States Patent [19]

Kiesow

[11] Patent Number: 5,983,643

[45] **Date of Patent: *Nov. 16, 1999**

[54] BURNER ARRANGEMENT WITH INTERFERENCE BURNERS FOR PREVENTING PRESSURE PULSATIONS

[75] Inventor: Hans-Jürgen Kiesow, Gebenstorf, Switzerland

[73] Assignee: Asea Brown Boveri AG, Baden, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/832,052

[22] Filed: Apr. 2, 1997

[30] Foreign Application Priority Data

Apr. 22, 1996 [DE] Germany ..... 196 15 910

[51] Int. Cl.[6] ..... F23R 3/34

[52] U.S. Cl. ..... 60/746; 60/747; 60/737; 431/8; 431/175

[58] Field of Search ..... 60/737, 733, 746, 60/747, 749; 431/8, 9, 175

[56] References Cited

U.S. PATENT DOCUMENTS

| | | | |
|---|---|---|---|
| 2,847,063 | 8/1958 | Reed et al. | 431/175 |
| 4,073,134 | 2/1978 | Koch | 60/39.26 |
| 4,168,609 | 9/1979 | Greenberg et al. | 60/749 |
| 4,805,411 | 2/1989 | Hellat et al. | 60/746 |
| 4,827,724 | 5/1989 | Maghon et al. | 60/737 |
| 5,412,938 | 5/1995 | Keller | 60/39.52 |
| 5,490,380 | 2/1996 | Marshall | 60/733 |
| 5,527,984 | 6/1996 | Stultz et al. | 431/9 |
| 5,957,571 | 11/1997 | Althaus et al. | 60/746 |

FOREIGN PATENT DOCUMENTS

| | | | |
|---|---|---|---|
| 0321809B1 | 6/1989 | European Pat. Off. . | |
| 0655581A1 | 5/1995 | European Pat. Off. . | |
| 0686812A1 | 12/1995 | European Pat. Off. . | |
| 2629761 | 1/1978 | Germany . | |
| 2826699 | 1/1979 | Germany . | |
| 2901099 | 7/1979 | Germany . | |
| 4339094A1 | 5/1995 | Germany . | |
| 0024706 | 2/1983 | Japan | 431/175 |
| 0267324 | 10/1989 | Japan | 60/746 |

*Primary Examiner*—Ted Kim
*Attorney, Agent, or Firm*—Burns, Doane, Swecker & Mathis, L.L.P.

[57] ABSTRACT

The invention relates to a main-burner arrangement of a combustion chamber (5), in particular for a gas turbine, at least two main-burner groups (13.1, 13.2), each comprising at least one burner (13) of the same size and geometry being provided for the purpose of equipping the combustion chamber (5), and at least one main-burner group representing the normal main burner(s) (13.1), the normal main burner(s) (13.1) producing a homogeneous flame front in the combustion chamber (5), and the other main-burner group interfering as an interference burner or burners (13.2) with the homogeneity of the flame front in the combustion chamber (5). In this burner arrangement, the interference burner(s) (13.2) is/are arranged in the combustion chamber (5) so as to be inclined or axially displaced in relation to the normal main burner(s) (13.1). This interferes with the symmetry and homogeneity of the flame front. The power of the combustion chamber is increased and pressure pulsations can be avoided.

6 Claims, 4 Drawing Sheets

BURNER ARRANGEMENT WITH INTERFERENCE BURNERS FOR PREVENTING PRESSURE PULSATIONS

BACKGROUND OF THE INVENTION

1. Field of the Invention

The invention relates to the area of combustion technology. It relates to a main-burner arrangement of a combustion chamber, in particular a gas-turbine combustion chamber, which can be used both for premix burners and for partial-premix burners and for diffusion burners.

2. Discussion of Background

To broaden the operating range of a combustion chamber, a pilot burner is used in low load ranges, and the actual burner group, the main burners, are used under high load conditions. The present invention relates to the arrangement of the main burners of a combustion chamber.

Main-burner arrangements of gas-turbine combustion chambers in which the burners all have the same orientation and are arranged in a symmetrically distributed manner around the combustion-chamber axis are known. Here, the burner axis is generally arranged parallel to the combustion-chamber axis or the central sectional plane in the case of annular combustion chambers, but also known are arrangements in which the burner axis and the combustion-chamber axis are inclined relative to one another. In general, the direction of flow of the burners is axial with a slightly radial component.

To produce an additional swirl in the combustion chamber, tangentially inclined burner arrangements are also known.

Common to all the embodiments is a regular arrangement of the burners or, in the case of annular combustion chambers, a regular arrangement of at least all the burners of a ring.

This arrangement is chosen in order to achieve as homogeneous a distribution of the combustion gases as possible even in the primary combustion zone, this leading to homogeneous exit distribution of the combustion-chamber exhaust gases. However, this results in inevitable disadvantages.

Particularly in the case of premix burners, a homogeneous reaction zone, i.e. a homogeneous "flame front" tends towards unwanted pressure pulsations. Since the distance between the burners and the combustion zone is the same, all the burners have the same time constant. If a slight disturbance, which is always present due to turbulence, now occurs, all the burners respond with conversion fluctuations. If, in turn, these fluctuations take place at a suitable point in time, a pulsation with amplitudes that are deleterious to the machine can build up.

The excitation of the pressure pulsations can also be effected by other mechanisms, for example periodic separations and entropy waves among many other factors.

A further disadvantage of such a regular arrangement of the burners consists in that transverse ignition from burner to burner is made more difficult since the transverse ignition is in this case brought about purely by swirl-induced transverse flow.

EP 0 655 581 A1has disclosed a burner with at least one first hollow member, in which gaseous oxidizing agent flows along, and at least one second hollow member for the introduction of fuel into the flow of oxidizing agent, and, in this burner, the mouths of the second hollow members are arranged asymmetrically in relation to the first hollow member, such that the mixing zone upstream of the flame contains a region in which the ratio of fuel to oxidizing agent is substoichiometric. Various members, for example tubes, of different cross-sections can also be arranged asymmetrically in the first hollow member. With this arrangement, the power of the combustion chamber is increased, on the one hand, and the intention is, on the other hand, to reduce the $NO_x$ emissions. The solution proposed is based on the fact that mixing at the burner outlet is not homogeneous, there being regions with higher or lower concentrations of fuel than the average. However, if significantly lower $NO_x$ emissions are to be achieved, the air/fuel mixture must have been completely mixed, i.e. the solution presented in EP 0 655 581 A1 is not useable.

The Applicant is also aware of a method for operating a combustion chamber equipped with premix burners, the combustion chamber being fitted with burners of the same geometry and size which are misaligned relative to one another. These burners are operated with different air ratios $\lambda$ and therefore have different flame temperatures. This leads to a widening of the operating range of the combustion chamber by making possible stable operation of the combustion chamber even in the low load range without staggering the burners. The disadvantage is that a certain increase in the $NO_x$ emissions has to be accepted.

Another possibility for misaligning the burners is known from EP 0 686 812 A1. This discloses a method for operating a burner for a gas turbine, in which the fuel is introduced at different axial locations along the burner, e.g. even before the swirl blading, and the flow of the fuel to a downstream combustion zone is controlled in order to achieve asymmetrical flow of the fuel via the burner. This likewise leads to a widening of the operating range of the burner since, in the low load range, severe acoustic noise and resonance (pressure pulsations) are avoided and a reduction in the dynamic pressure loss without an increase in the $NO_x$ emissions is achieved. Here, however, the introduction of gas ahead of the swirl blading generates a combustible mixture ahead of the swirl generators. Experience has shown that such arrangements tend toward flashback with the risk that the blades will be burned away. The very complex construction of the fuel feed system is also disadvantageous.

SUMMARY OF THE INVENTION

Accordingly, one object of the invention is to develop a novel main-burner arrangement, in particular for gas-turbine combustion chambers, by means of which the power of the combustion chamber can be varied in a specific manner and in which pressure pulsations, which can have various causes, are avoided.

According to the invention, this is achieved with a main-burner arrangement in which that the interference burner(s) are arranged so as to be inclined in the combustion chamber in relation to the normal main burner(s). According to the invention, this is also achieved by the interference burner(s) being arranged in such a way as to be axially displaced in the combustion chamber in relation to the normal main burner (s).

This main-burner arrangement according to the invention in a silo-type or can-type combustion chamber or annular combustion chamber interferes with the symmetry or homogeneity of the flame front. The advantages of the invention additionally consist in that the inclination of the interference burners gives rise to a transverse flow which considerably facilitates the transverse ignition of the burners, with the result that the stability region of the burners is displaced in the direction of lower loads. The interference burners furthermore also have a vibration-damping action.

It is particularly expedient if the interference burner(s) is/are arranged so as to be inclined in the circumferential direction.

It is furthermore advantageous if the interference burner (s) is/are arranged so as to be inclined in the radial direction, i.e. deviations in the angle relative to the combustion-chamber axis or central section plane of the combustion chamber are provided. The preferred inclination of the burner(s) is one at which the burner(s) does/do not fire at the combustion-chamber wall, the burner mouth/burner mouths instead pointing away from the nearest part of the combustion-chamber wall. This has the advantage that the wall is not subjected to excessive thermal loading.

Finally, it is advantageous to choose a burner arrangement in which the normal main burners and the interference burners are arranged in asymmetrical patterns in the combustion chamber. This is the simplest way of suppressing unwanted pressure pulsations. However, symmetrical patterns are also conceivable.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
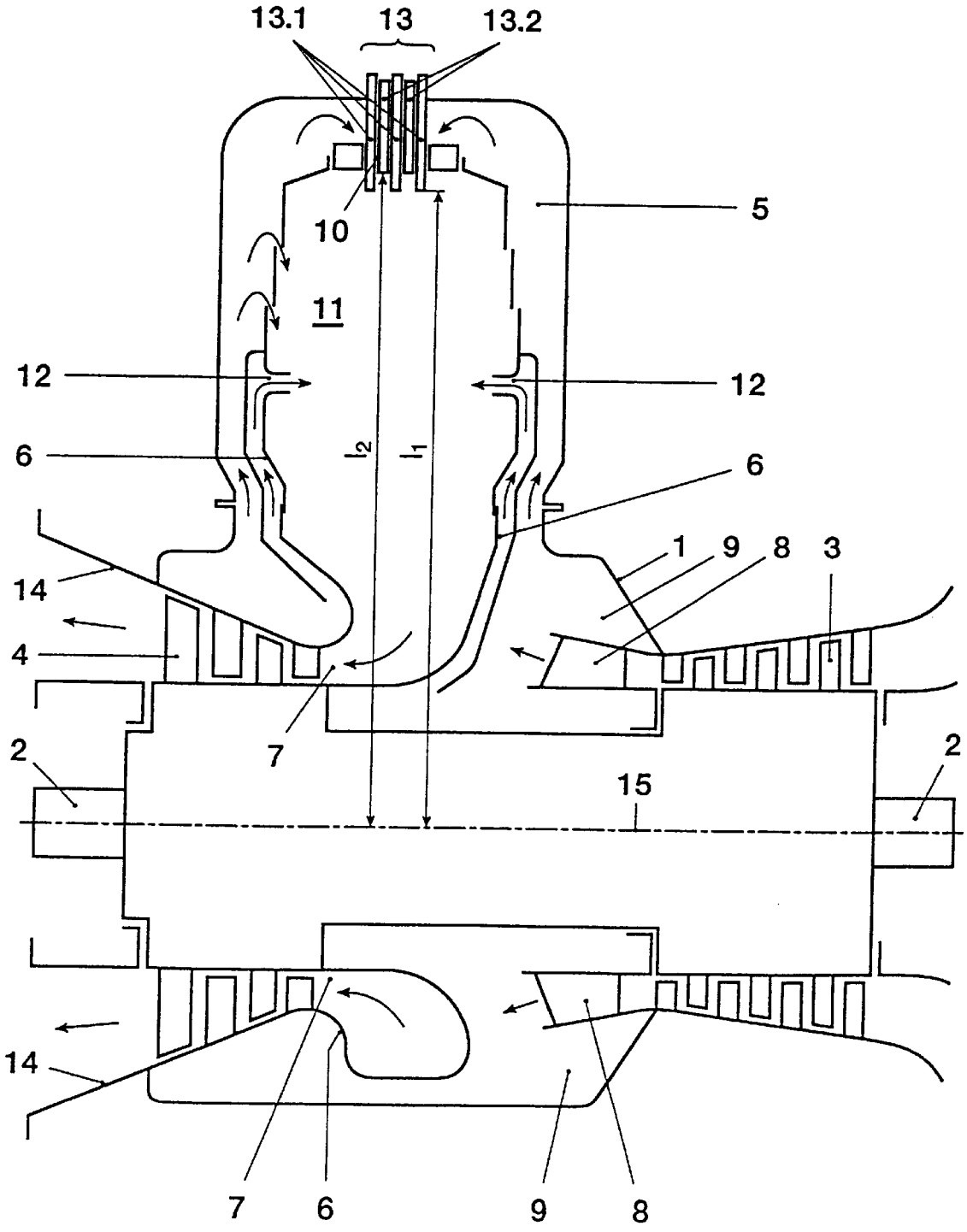
FIG. 1 shows a partial longitudinal section of a gas turbine with a silo-type combustion chamber with axially displaced interference burners.

Referring now to the drawings, wherein like reference numerals designate identical or corresponding parts throughout the several views and the direction of flow of the media is indicated by arrows, FIG. 1 shows a gas turbine system in a partial longitudinal section. A compressor 3 and a turbine 4 are arranged on a common shaft 2 in a casing 1. A hot-gas casing 6 establishes the connection between a silo-type combustion chamber 5 mounted on the turbine casing 1 and the turbine inlet 7. From the compressor 3, compressed air passes through an air duct 8 into an interspace 9, which is surrounded by the turbine casing 1 and from which part of the air passes as primary air, via a combustion-air inlet 10, into the combustion volume 11 of the combustion chamber 5, while another part of the air is mixed into the hot gas in the combustion volume 11 as secondary air via mixing-air nozzles 12. Fuel is fed to the combustion chamber 5 via the burners 13, which are illustrated schematically, and this fuel is burned with the air passing into the combustion chamber 5 to form hot gas. The hot gases from the silo-type combustion chamber 5 pass through the turbine inlet 7 in the direction of the arrow and into the turbine 4, in which they expand, and leave the turbine 4 through an exhaust nozzle 14.

The combustion chamber 5 is fitted with a plurality of burners 13. In this exemplary embodiment, the burners 13 are diffusion burners, which are divided into two main-burner groups, namely into the normal main-burner group 13.1 and the interference-burner group 13.2. The two main-burner groups 13.1 and 13.2 are formed by burners of the same geometry and the same size and, according to the invention, the normal burners, i.e. the burners of burner group 13.1, form an assembly at the same axial distance $l_1$ from the shaft axis 15, while the interference burners, i.e. the burners of burner group 13.2, are at a different axial distance $l_2$ from the shaft axis 15. In the present exemplary embodiment, the axial distance of all the interference burners 13.2 from the shaft axis 15 is constant. In other exemplary embodiments, the distances $l_2$ can, of course, also vary within the interference-burner group 13.2. The only important point is that the interference burners 13.2 should interfere with the symmetrical assembly of the normal main burners 13.1 and thereby generate inhomogeneities in the flame front, thus, for example, preventing pulsations in the burner from escalating to damaging amplitudes, damping them instead.

Figure 2:
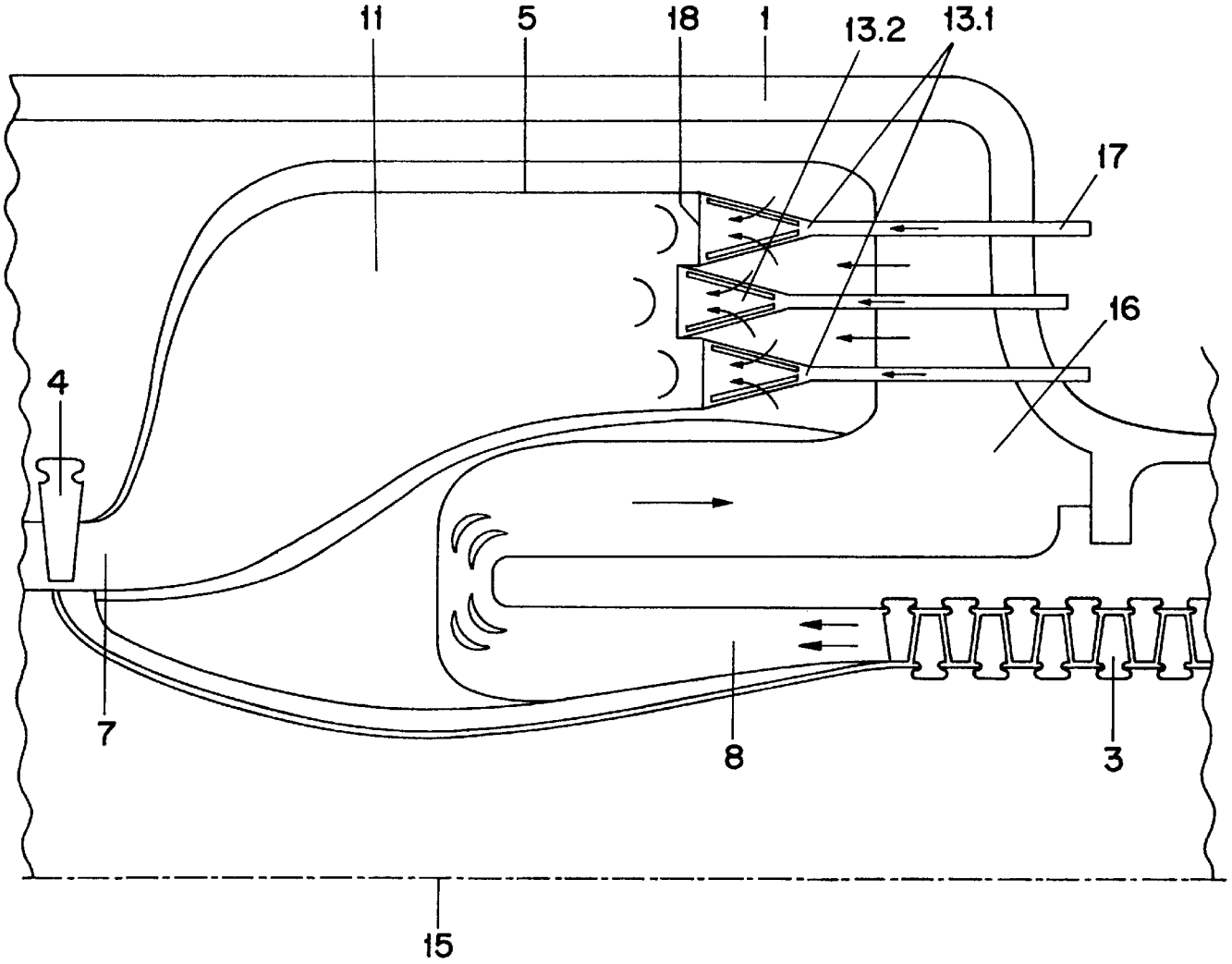
FIG. 2 shows a partial longitudinal section through a gas turbine with an annular combustion chamber fitted with premix burners, the interference burner being displaced axially in comparison with the normal main burners.

FIG. 2 shows a partial longitudinal section through a gas turbine with an annular combustion chamber 5 fitted with premix burners 13. In this exemplary embodiment, the burners 13 are premix burners of the double-cone type, which is described, for example, in U.S. Pat. No. 4,932,861 to Keller et al.

A compressor 3 and a turbine 4 are arranged on a common shaft 2 in a casing 1. Between the compressor 3 and the turbine 4 there is an annular combustion chamber 5, which is connected via the turbine inlet 7 to the turbine 4, of which only one guide vane of the first guide-vane row is shown. From the compressor 3, of which only the last compressor stages are shown in FIG. 2, compressed air passes through an air duct 8, which is designed as a reversing diffuser, into a plenum 16 arranged between the compressor 3 and the annular combustion chamber 5. From the plenum 16, the combustion air flows via tangential air inlet slots into the main burners 13.1 and 13.2 and mixes in the interior of the burners with the fuel introduced via fuel lances 17. The mixture ignites only at the downstream end of the burners. The flame is stabilized by a recirculation zone 18. The hot gases are accelerated at the downstream end of the combustion chamber 5, flow via the turbine inlet 7 to the turbine 4, expand there, and leave the turbine 4 through an exhaust nozzle (not shown in FIG. 2).

In contrast to the known prior art, the main burners 13 are not arranged in a regular pattern in the annular combustion chamber 5. Only the normal main burners 13.1 are arranged in a regular pattern in the combustion chamber 5 to ensure that as homogeneous distribution of the combustion gases as possible can be achieved, even in the primary combustion zone, this leading in turn to homogeneous outlet distribution of the combustion-chamber exhaust gases. The disadvantage of pressure pulsations caused by the homogeneous reaction zone and of insufficient transverse ignition from burner to burner is removed by the burner arrangement according to the invention. The interference burners (main-burner group 13.2) are displaced axially in relation to the normal main burners 13.1. The effect of this is that the recirculation zones of the individual burners no longer lie in one plane. The distance between the burners and the combustion zone is thus no longer the same for all the burners, the interference burners 13.2 and the normal main burners 13.1 having different time constants. If a slight disturbance due to turbulence arises, the conversion fluctuations of the burners are offset in terms of time, so that pressure pulsations are damped.

Figure 3:
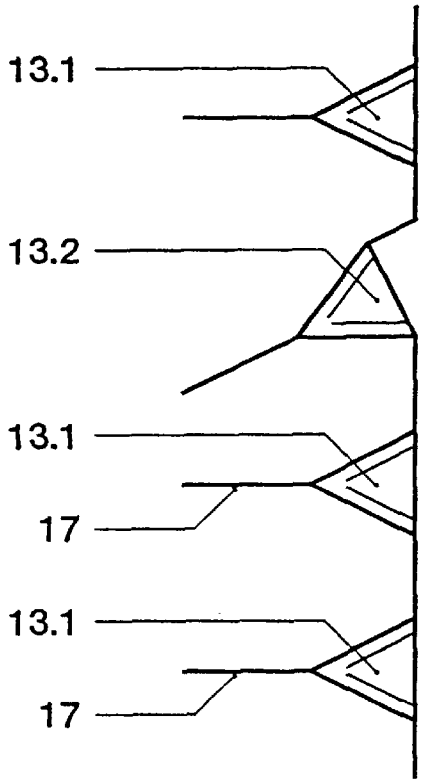
FIG. 3 shows a development of an annular combustion chamber in the plane of a row of main burners, the interference burner being arranged in such a way as to be inclined in relation to the normal main burners.
Figure 4:
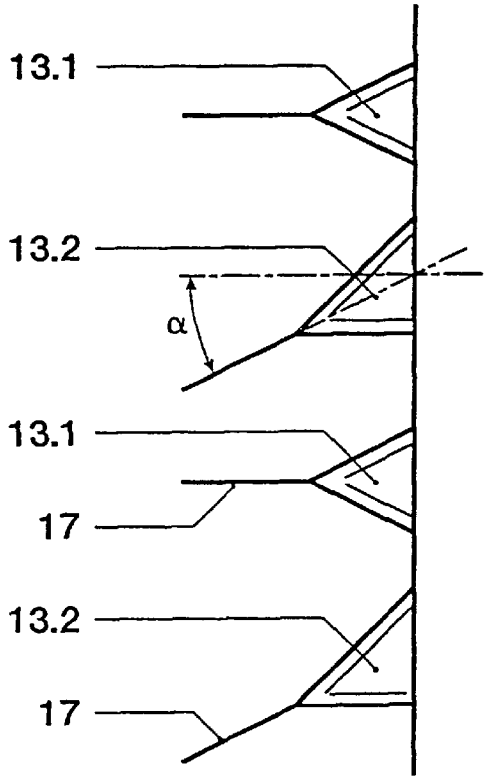
FIG. 4 shows another, variant embodiment with respect to FIG. 3.

FIG. 3 and FIG. 4 show further exemplary embodiments of the invention. They each show a development of an annular combustion chamber in the plane of a row of burners, the interference burner 13.2 being arranged so as to be inclined in the circumferential direction in comparison with the normal main burners 13.1. Premix burners of the double-cone type have again been used here as burners. The angle of the interference burners 13.2 gives rise to a transverse flow which considerably facilitates transverse ignition of the burners.

Deviations in the angle relative to the axis of the combustion chamber or to the central cross-sectional plane of the combustion chamber are also possible, so that the interference burners 13.2 are askew relative to the axis of the combustion chamber or machine.

Figure 5:
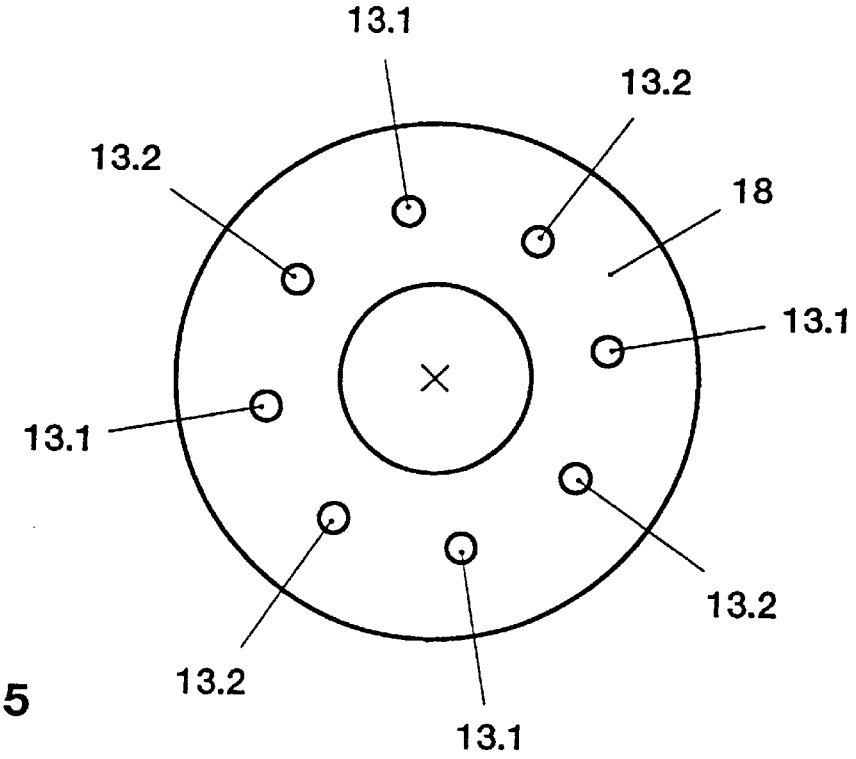
FIG. 5 shows a schematic cross-section of an annular combustion chamber with normal main burners and interference burners, these being arranged in a symmetrical pattern.

FIG. 5 shows a schematic cross-section of an annular combustion chamber with normal main burners 13.1 and interference burners 13.2 in the plane of the front plate 18, the burners being arranged in a symmetrical pattern, the main burners 13.1 and interference burners 13.2 being provided alternately in a ring at equal distances from one another. The important point is that the frequency is thereby increased.

Figure 6:
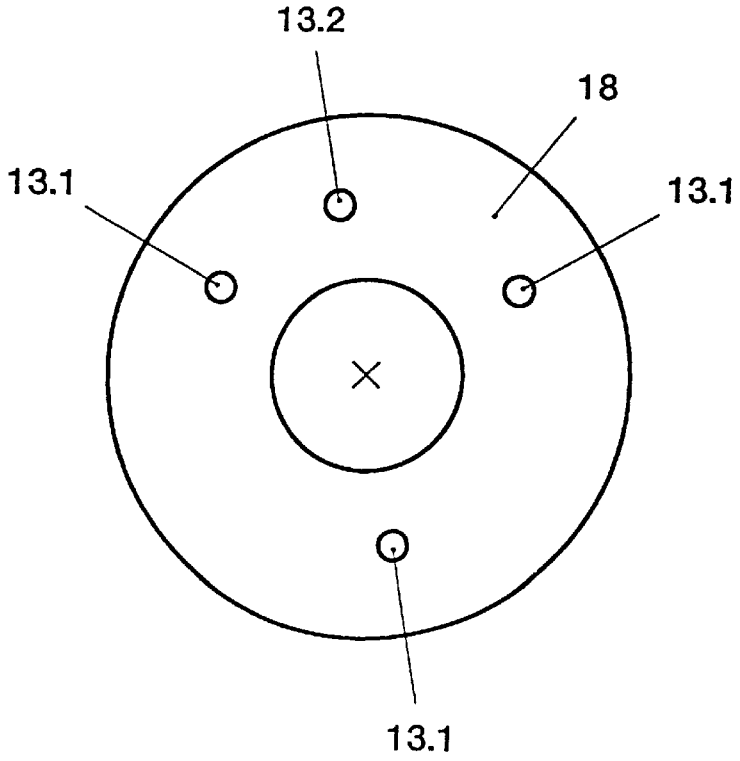
FIG. 6 shows a schematic cross-section of an annular combustion chamber with normal main burners and interference burners, these being arranged in an asymmetrical pattern.

However, the advantages of the invention can also be achieved with the asymmetrical pattern illustrated by way of example in FIG. 6, in which only one interference burner 13.2 is arranged in the ring of the annular combustion chamber.

The invention is, of course, not limited to the exemplary embodiments just described. The main-burner arrangement is suitable not only for premix burners but also for partial-premix and diffusion burners, which can be arranged either in annular combustion chambers or in silo-type or annular combustion chambers. The main-burner arrangement according to the invention can furthermore be used for boiler firing systems.

Using the invention, it is possible, not only to damp the pressure pulsations described above by means of the homogeneous flame front but also pressure pulsations which are caused by other mechanisms, e.g. periodic separations and entopy waves. The transverse ignition of the burners is improved and, furthermore, the exit profile of the combustion-chamber exhaust gases can thereby be adapted in a specific manner to the requirements of the turbine.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letter Patent of the United States is:

1. A main burner arrangement in a combustion chamber having a longitudinal axis and a main combustion area, bounded by an upstream wall comprising a plurality of identical main burners mounted on the upstream wall wherein the identical main burners include an arrangement of normal and interference burners, arranged in the main combustion area as at least one normal burner having an axial direction to produce a homogeneous flame front in the combustion chamber and at least one interference burner positioned in the main combustion area to be inclined relative to the axial direction of the at least one normal burner and said upstream wall, said at least one interference burner being arranged so as to produce a flame front interfering with the homogeneous flame front of said at least one normal burner to prevent pressure pulsations.

2. The main-burner arrangement as claimed in claim 1, wherein the combustion chamber is one of a silo and annular chamber, and wherein the at least one interference burner is inclined in a circumferential direction of the combustion chamber.

3. The main-burner arrangement as claimed in claim 1, wherein the combustion chamber is one of a silo and an annular chamber and wherein the at least one interference burner is inclined in a radial direction of the combustion chamber.

4. The main-burner arrangement as claimed in claim 3, wherein the at least one interference burner is inclined in the radial direction in such a way that an opening of said at least one interference burner points away from a nearest part of a combustion-chamber wall.

5. The main burner arrangement as claimed in claim 1, wherein the at least one interference burner and the at least one normal are arranged in an asymmetrical pattern in the combustion chamber.

6. The main-burner arrangement as claimed in claim 1, wherein the at least one interference burner and the at least one normal burner are arranged in a symmetrical pattern in the combustion chamber.

* * * * *